US012601515B2

(12) United States Patent
Morosky

(10) Patent No.: US 12,601,515 B2
(45) Date of Patent: Apr. 14, 2026

(54) AIR EVACUATOR

(71) Applicant: William Morosky, Erie, PA (US)

(72) Inventor: William Morosky, Erie, PA (US)

( * ) Notice: Subject to any disclaimer, the term of this patent is extended or adjusted under 35 U.S.C. 154(b) by 828 days.

(21) Appl. No.: 17/921,354

(22) PCT Filed: May 10, 2021

(86) PCT No.: PCT/US2021/031664
§ 371 (c)(1),
(2) Date: Oct. 26, 2022

(87) PCT Pub. No.: WO2021/226604
PCT Pub. Date: Nov. 11, 2021

(65) Prior Publication Data

US 2023/0175720 A1 Jun. 8, 2023

Related U.S. Application Data

(60) Provisional application No. 63/022,425, filed on May 8, 2020.

(51) Int. Cl.
*F24F 8/22* (2021.01)
*F24F 7/06* (2006.01)
*F24F 8/108* (2021.01)

(52) U.S. Cl.
CPC ..... *F24F 8/22* (2021.01); *F24F 7/065* (2013.01); *F24F 8/108* (2021.01)

(58) Field of Classification Search
None
See application file for complete search history.

(56) References Cited

U.S. PATENT DOCUMENTS

| | | | | |
|---|---|---|---|---|
| 3,235,325 | A * | 2/1966 | Storchheim | F24F 8/22 D23/366 |
| 3,510,228 | A | 5/1970 | May | |
| 4,259,897 | A | 4/1981 | Nederman | |
| 4,446,861 | A | 5/1984 | Tada | |
| 4,860,644 | A | 8/1989 | Kohl et al. | |
| 6,780,213 | B2 | 8/2004 | Chang et al. | |
| 8,460,417 | B2 | 6/2013 | Reid et al. | |
| 2003/0146082 | A1 * | 8/2003 | Gibson | A61L 9/205 422/186.3 |

(Continued)

FOREIGN PATENT DOCUMENTS

GB 2334448 A 8/1999

*Primary Examiner* — Andrew Smyth
(74) *Attorney, Agent, or Firm* — Jon L. Woodard; Woodard International Law

(57) ABSTRACT

An air evacuator includes a dome having an exterior surface, an interior funneling surface, an air intake end, and an air outlet end, the dome being significantly wider at the air intake end than at said air outlet end. An inlet allows air from outside the air evacuator to be drawn into the dome. A vent tube is positioned to receive air from the air outlet end of the dome. An air pump is positioned to move air in the air evacuator and through a filter. One or more interior-aimed ultraviolet lamps positioned within the air evacuator treat and disinfect air as it is drawn into the air evacuator. A light trap extends substantially across the air intake end of the dome to prevent ultraviolet light from one or more ultraviolet lamps from shining directly out from within the dome through the air intake end of the dome.

121 Claims, 7 Drawing Sheets

(56) References Cited

U.S. PATENT DOCUMENTS

| | | | | |
|---|---|---|---|---|
| 2012/0045981 | A1 | 2/2012 | Nguyen | |
| 2015/0374867 | A1* | 12/2015 | Patterson, Jr. | A61L 2/202 422/186.3 |
| 2016/0317694 | A1* | 11/2016 | Leonaggeo | B01D 53/0407 |
| 2019/0360680 | A1* | 11/2019 | Niemiec | F21V 9/08 |
| 2020/0072527 | A1* | 3/2020 | Acar | F25D 17/065 |

* cited by examiner

AIR EVACUATOR

BACKGROUND OF THE INVENTION

Health care professionals in dentistry, primary care medicine, optometry, dermatology, orthopedic surgery, and other similar medical fields frequently encounter contaminated aerosols generated by procedures and/or by the exhaling of patients or other care givers during treatments, consults, and evaluations. Similar dangers are also faced by those working in salons, retail checkouts, or those working in any other environment requiring physical interactive activity or close contact with others.

In such working environments, it is generally considered desirable to remove and/or detoxify contaminated aerosols and exhaled air from work or activity areas to reduce the likelihood that the contaminated air will be re-inhaled or deposited on proximate surfaces. However the use of certain decontamination techniques such as ultraviolet (UV) light has been of limited usefulness due to limitations on using UV light around humans.

SUMMARY OF THE INVENTION

An air evacuator includes a dome having an exterior surface, an interior funneling surface, an air intake end, and an air outlet end, the dome being significantly wider at the air intake end than at said air outlet end. An inlet allows air from outside the air evacuator to be drawn into the dome. A vent tube is positioned to receive air from the air outlet end of the dome. An air pump is positioned to move air in the air evacuator and through a filter. One or more interior-aimed ultraviolet lamps positioned within the air evacuator treat and disinfect air as it is drawn into the air evacuator. A light trap extends substantially across the air intake end of the dome to prevent ultraviolet light from one or more ultraviolet lamps from shining directly out from within the dome through the air intake end of the dome.

In some embodiments, at least one exterior-aimed ultraviolet lamp positioned on the air evacuator treats air or surfaces exterior to the air evacuator when humans are not in the vicinity of the air evacuator. In other embodiments include first stage interior-aimed ultraviolet lamps positioned on the interior funneling surface and within the dome, second stage interior-aimed ultraviolet lamps positioned within the air evacuator between the first stage interior-aimed ultraviolet lamp the air pump, and third stage interior-aimed ultraviolet lamps positioned within the air evacuator in the vent tube to allow for repeated, multiple stage treatment of air. Further embodiments utilize multiple domes, light traps, air pumps, filters and additional stages of ultraviolet lamps to allow for the repeated treatment of air drawn into the air evacuator.

BRIEF DESCRIPTION OF THE DRAWINGS

For a more complete understanding and appreciation of this invention, and its many advantages, reference will be made to the following Detailed Description of the Invention taken in conjunction with the accompanying drawings.

DETAILED DESCRIPTION OF THE INVENTION

Figure 1A:
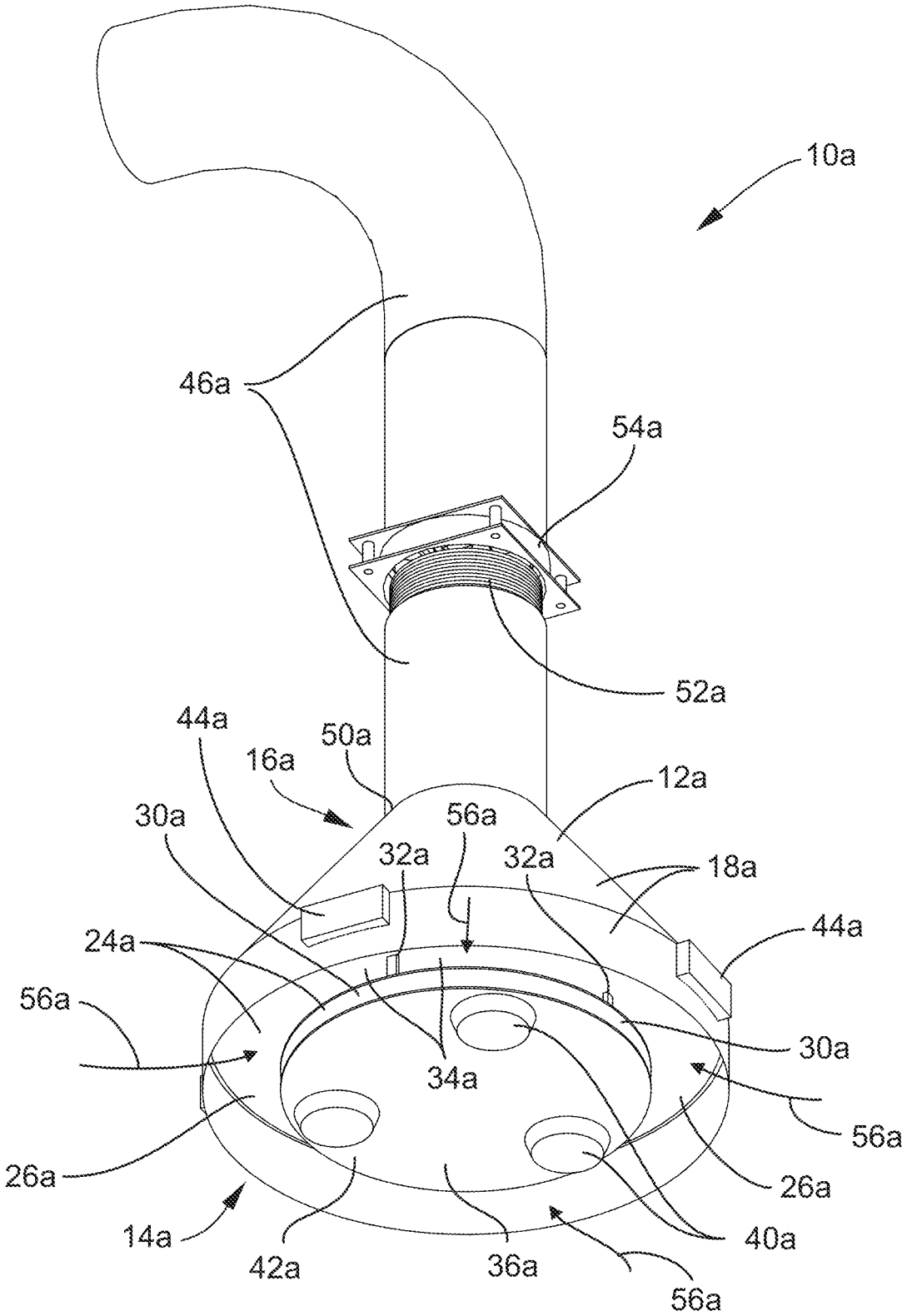
FIG. 1A is a lower perspective view of an air evacuator according to one embodiment of the invention.

Referring to the drawings, some reference numerals are used to designate the same or corresponding parts through several of the embodiments and figures shown and described. Variations in corresponding parts are denoted in specific embodiments with the addition of lowercase letters. Subsequent variations in components that are depicted in the figures but not described are intended to correspond to the specific embodiments mentioned earlier and are discussed to the extent that they vary in form or function. It will be understood generally that variations in the embodiments could be interchanged without deviating from the intended scope of the invention.

Figure 1B:
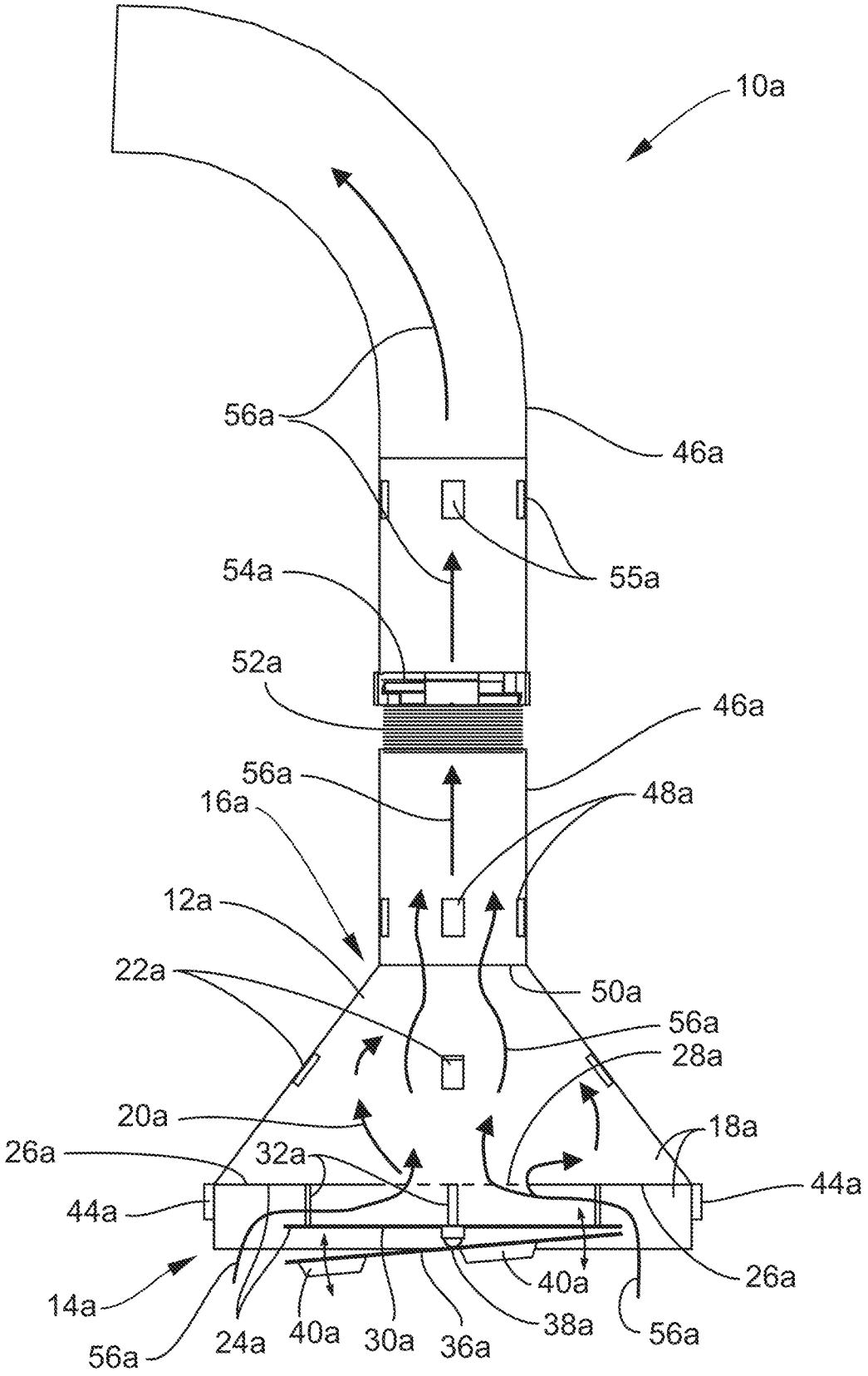
FIG. 1B is side cross sectional view of the air evacuator of FIG. 1A.
Figure 2:
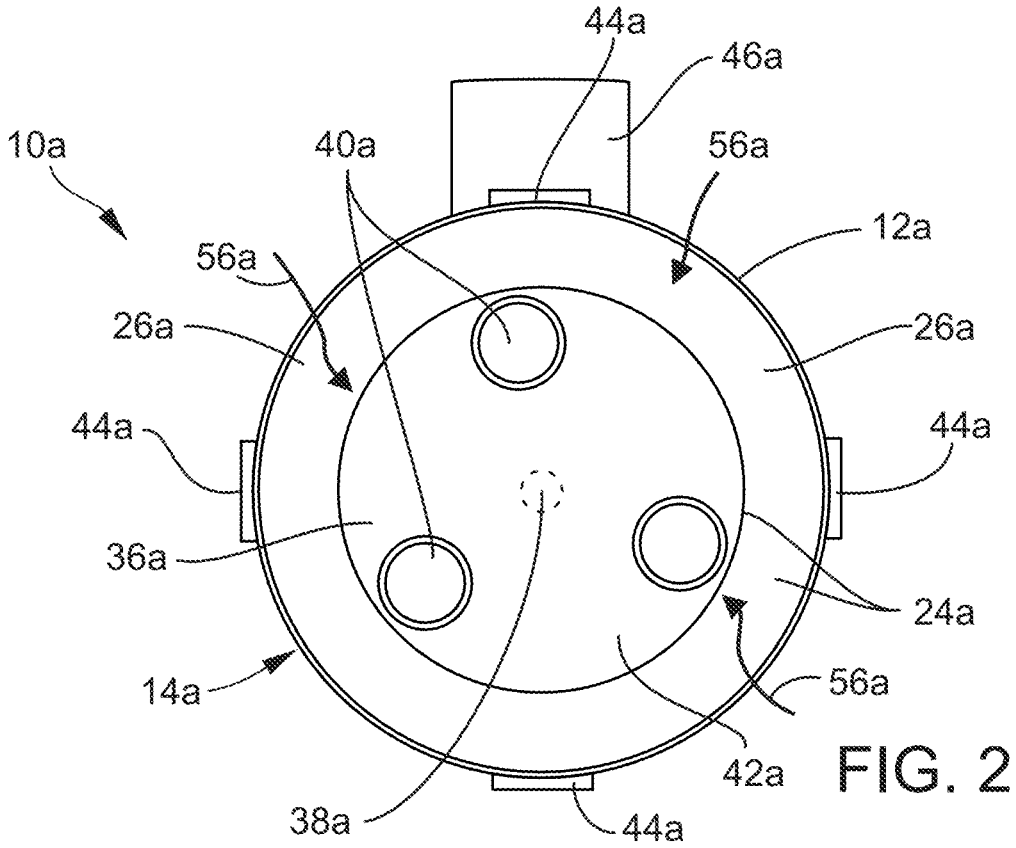
FIG. 2 is a bottom view of the air evacuator of FIG. 1A.

FIG. 1A depicts a lower perspective view of an air evacuator 10*a* of the invention constructed around a conical dome 12*a* having an air intake end 14*a* and air outlet end 16*a*, the dome 12*a* being significantly wider at the air intake end 14*a* than at the air outlet end 16*a*. As best understood by comparing FIG. 1A with the side cross sectional view of the air evacuator 10*a* in FIG. 1B and bottom view in FIG. 2, the dome 12*a* has an exterior surface 18*a* and an interior funneling surface 20*a*. Several interior-aimed $1^{st}$ stage ultraviolet lamps 22*a* are positioned around the inside of the dome 12*a* along its interior funneling surface 20*a*.

A light trap 24*a* is positioned within the dome 12*a* near the intake end 14*a* and extends across the width of the intake end 14*a*. The light trap 24*a* includes a planar inner ring 26*a* that is rigidly positioned within the dome 12*a* near the intake end 14*a* and includes a center hole 28*a* serving as the primary inlet into the dome 12*a* through the intake end 14*a*. The light trap 24*a* also includes an outer plate 30*a* positioned immediately below the center hole 28*a* of the inner ring 26*a*, the inner ring 26*a* being connected to the outer plate 30*a* with spacers 32*a*. The spacers 32*a* retain the outer plate 30*a* in fixed position relative the inner ring 26*a*. The spacers 32*a* also maintain a sufficient space between the inner ring 26*a* and outer plate 30*a* to form an inlet 34*a* for significant volumes of air to be drawn into the air evacuator 10*a* through the inlet 34*a* and center hole 28*a* of the inner ring 26*a*. However, the space between the inner ring 26*a* and outer plate 30*a* is also sufficiently small to prevent any line of site view of the center hole 28*a* from outside the air evacuator 10*a*, as best understood by comparing FIGS. 1A and 1B, allowing the light trap to prevent any light from shining directly from within the dome 12*a* to any location below the air evacuator 10*a*.

A lamp plate 36*a* is attached to the bottom surface of the outer plate 30*a* with a ball pivot 38*a*. The lamp plate 36*a* itself has multiple non-UV illuminating lamps 40*a* positioned on the bottom surface 42*a* of the lamp plate 36*a*. The ball pivot 38*a* allows the lamp plate 36*a* to rotate around a 360 degree circle below the dome 12*a* to allow for better directed non-UV illuminating light to locations in the immediate vicinity of air evacuator 10*a*. In some embodiments, each individual non-UV illuminating lamp 40*a* may also be individually adjustable to allow for fine tuning the direction of illumination or for simultaneous illumination of multiple location in the activity area.

Multiple exterior-aimed ultraviolet lamps 44*a* are positioned on the air evacuator 10*a* at locations around the exterior surface 18*a* of the dome 12*a*. The exterior-aimed ultraviolet lamps 44*a* operate independently of the multiple non-UV illuminating lamps 40*a* on the lamp plate 36*a*. The locations of the exterior-aimed ultraviolet lamps 44*a* on the dome 12*a* allow for the maximization of UV light directed throughout the immediate vicinity of the air evacuator 10*a*, and especially toward any activity areas below the dome 12*a*.

A vent tube 46*a* is attached to the outlet end 16*a* of the dome 12*a* to receive and channel air from within the dome 12*a*. The vent tube 46*a* has an interior-aimed second stage of ultraviolet lamps 48*a* located inside the vent tube 46*a* near the coupling point 50*a* with the dome 12*a*. A filter 52*a* and air pump, which in the depicted embodiment is a fan 54*a*, are located above the second stage of ultraviolet lights 48*a* to draw and filter air through the air evacuator 10*a*. An interior-aimed third stage of ultraviolet lamps 55*a* is located above the filter 52*a* and fan 54*a* in the vent tube 46*a*. Although shown and described as a fan 54*a* in FIG. 8, it will be appreciated that other types of air pumps such as impellers, diaphragm pumps, and other similar devices can also be used within the contemplated scope of the invention.

In some contemplated invention embodiments, portions of the light trap 24*a*, interior funneling surface 20*a* of the dome 12*a*, and vent tube 46*a* can be lined with an antimicrobial material such as copper, brass, or a synthetic material such as GERMSAFE24™ Film available from Germsafe24 LLC of Boca Raton, Florida. In some contemplated embodiments of the invention, portions or all of the light trap 24*a*, dome 12*a*, vent tube 46*a*, fan Ma, filter 52*a*, or fan 54*a* can be entirely constructed from such antimicrobial materials.

In operation, the air evacuator 10*a* is positioned over an activity area such a surgical table in an operating room, patient chair or examination table in a dentist's or physician's office, a salon chair in a hair or nail salon, or any other activity area requiring heightened levels of hygiene. A professional utilizing the air evacuator 10*a* can direct the non-UV light of the multiple illuminating lamps 40*a* toward a particular task at hand by adjusting the lamp plate 36*a* on its ball pivot 38*a*. Although the multiple illuminating lamps 40*a* shine non-UV light toward the task below the air evacuator 10*a*, the exterior-aimed ultraviolet lamps 44*a* remain turned OFF to prevent UV light exposure to patients, professionals, and other humans in the vicinity of the air evacuator 10*a*. However, both the fan 54*a* and interior aimed first, second, and third stage ultraviolet lamps 22*a*, 48*a*, and 55*a* are turned ON, the fan 54*a* drawing airflow 56*a* through the inlet 34*a* of the light trap 24*a*, into and through the dome 12*a*, and into and through the vent tube 46*a* and filter 52*a*. The vent tube 46*a* then channels the airflow 56*a* away from the activity area for disposal or recirculation.

As the airflow 56*a* is drawn into the air evacuator 10*a*, it is exposed to the first stage of ultraviolet lamps 22*a* as it enters the dome 12*a* for initial UV treatment. Due to the conical shape and interior funneling surface 20*a* of the dome 12*a*, the airflow 56*a* may experience differences in air pressure due to its movement and relative volume capacities as it travels through the air evacuator 10*a*, leading to further agitation and stirring as the airflow 56*a* is initially subject to UV light. As the flowing air 56*a* exits the dome 12*a* and initially enters the vent tube 46*a*, it is subject to further UV treatment from the interior-aimed second stage ultraviolet lamps 48*a* before being drawn through the filter 52*a* by the fan 54*a* for air filtration. The airflow 56*a* is subject to further UV light treatment by the interior-aimed third stage ultraviolet lamps 55*a* after it passes the fan 54*a* and is channeled away by the vent tube 46*a* for disposal or recirculation. If any of the light trap 24*a*, dome 12*a*, vent tube 46*a*, fan Ma, filter 52*a*, or fan 54*a* are fully or partially constructed of antimicrobial materials such as copper, brass, or synthetic antimicrobial material, such materials further contribute to purification of the flowing air 56*a* as it passes through the air evacuator 10*a* prior to air disposal or recirculation.

As air 56*a* is drawn from the activity area into the air evacuator 10*a* and is subjected to UV light treatment, the light trap 24*a* prevents UV light from the interior-aimed first and second stage ultraviolet lamps 22*a* and 48*a* from shining through the dome 12*a* to the activity area and/or other areas in the vicinity of the air evacuator 10*a*, though airflow 56*a* through the inlet 34*a* and light trap 24*a* is not restricted. This allows the air evacuator 10*a* to continuously operate and purify air from the activity area without exposing UV light to humans in the activity area's vicinity.

Once human activity has ceased in the activity area, such as when a particular room is not in use or possibly during overnight hours, it may or may not remain desirable to continue operating the interior-aimed first, second, and third stage ultraviolet lamps 22*a*, 48*a*, and 55*a* and the fan 54*a*, which may be switched OFF or ON depending on the requirements for air evacuation and purification. However, it may still be preferable to operate the exterior-aimed ultraviolet lamps 44*a*, which are operated independently from the interior-aimed ultraviolet lamps 22*a*, 48*a*, and 55*a* and fan 54*a*. In this way, the air evacuator 10*a* allows for the entire activity area, room, or vicinity surrounding the air evacuator 10*a* to receive UV light treatment and disinfection only during intervals when patients, professionals, technicians, and other humans are not present.

Figure 3A:
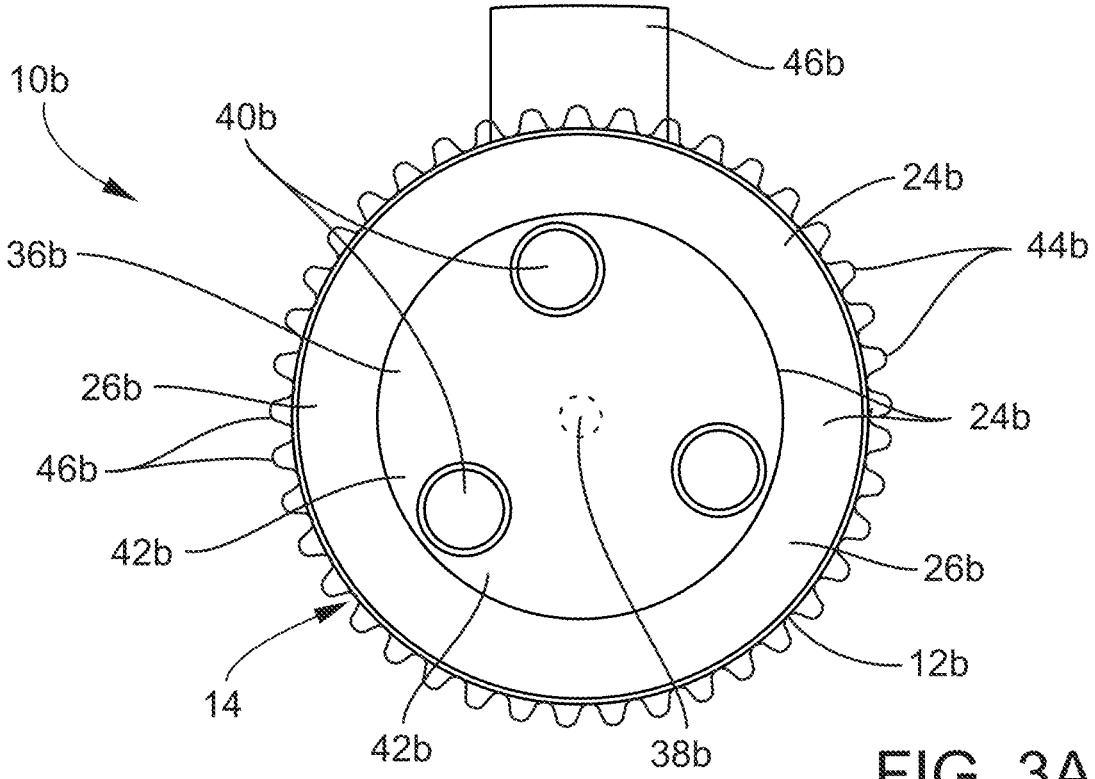
FIG. 3A is a bottom view of an air evacuator according to one embodiment of the invention.

Although the use of ultraviolet lamps has been shown and described using single and multiple lamps, it will be appreciated that the use of other styles of ultraviolet lamps, including elongated and nonconventional ultraviolet light sources, are also possible. For example, FIG. 3A depicts a bottom view of an air evacuator 10*b* of the invention also having a light trap 24*b*, inner ring 26*b*, light plate 36*b*, ball pivot 38*b*, and non-UV illuminating lamps 40*b*, in which exterior-aimed UV light is provided by an exterior aimed ultraviolet light string 44*b* containing numerous ultraviolet lamps and circumferentially positioned around the dome 12*b*. The ultraviolet light string 44*b* would also allow for ON/OFF operation that would be independent of the non-UV illuminating lights 40*b* and other interior-aimed ultraviolet illuminating lamps or fans. This and other such variations are contemplated to be within the intended scope of the invention.

Figure 3B:
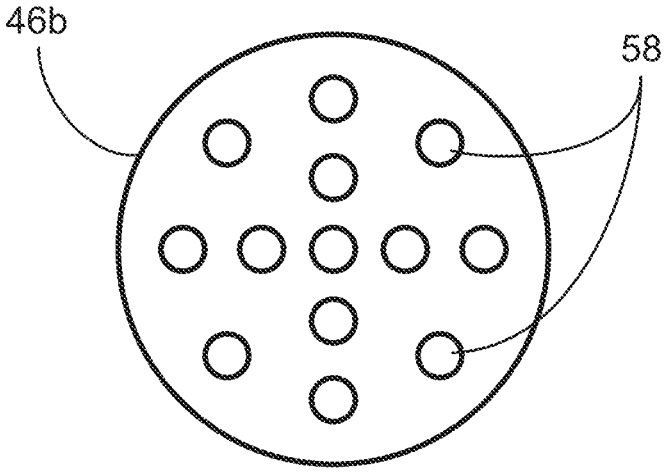
FIG. 3B is a cross sectional bottom view of an enclosed bundle of ultraviolet lamps according to one embodiment of the invention.
Figure 3C:
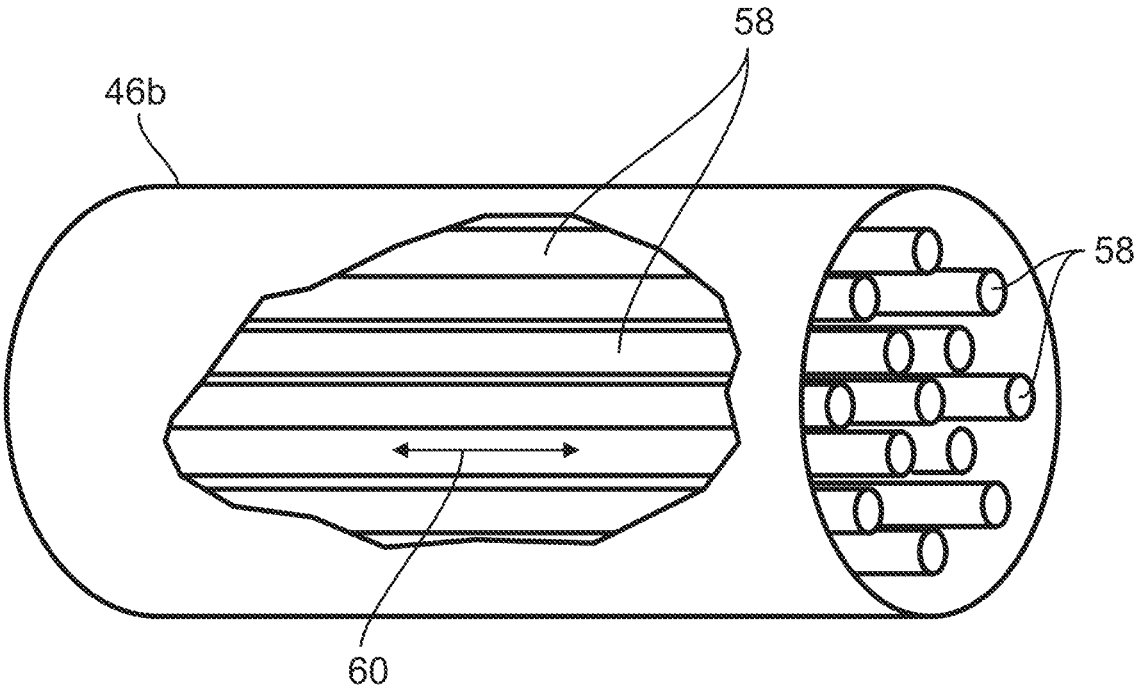
FIG. 3C is a cutout side perspective view of the enclosed bundle of ultraviolet lamps of FIG. 3B.

Variations to the interior-aimed ultraviolet lights are also possible and are within the contemplated scope of the invention. For example. FIG. 3B depicts a cross sectional bottom view and FIG. 3C a cutaway perspective side view of a bundle of interior-aimed, elongated ultraviolet lamps 58, each having a major structural dimension 60 and positioned in a parallel bundle along a section of vent tube 46*b*, similar to the vent tube 46*a* of FIGS. 1A and B. The major structural dimension 60 of the bundle of ultraviolet lamps 58 is generally parallel to the airflow direction within the vent tube 46*a* and allows for intensified UV light treatment of flowing air throughout the length of the bundle 58, as would be useful for interior-aimed UV light treatment in some contemplated embodiments. For example, in some applications, the depicted bundle of ultraviolet lamps 58 would be appropriate to substitute either the second or third stage interior-aimed ultraviolet lamps 48*a* and 55*a* depicted in FIG. 1B.

Figure 4:
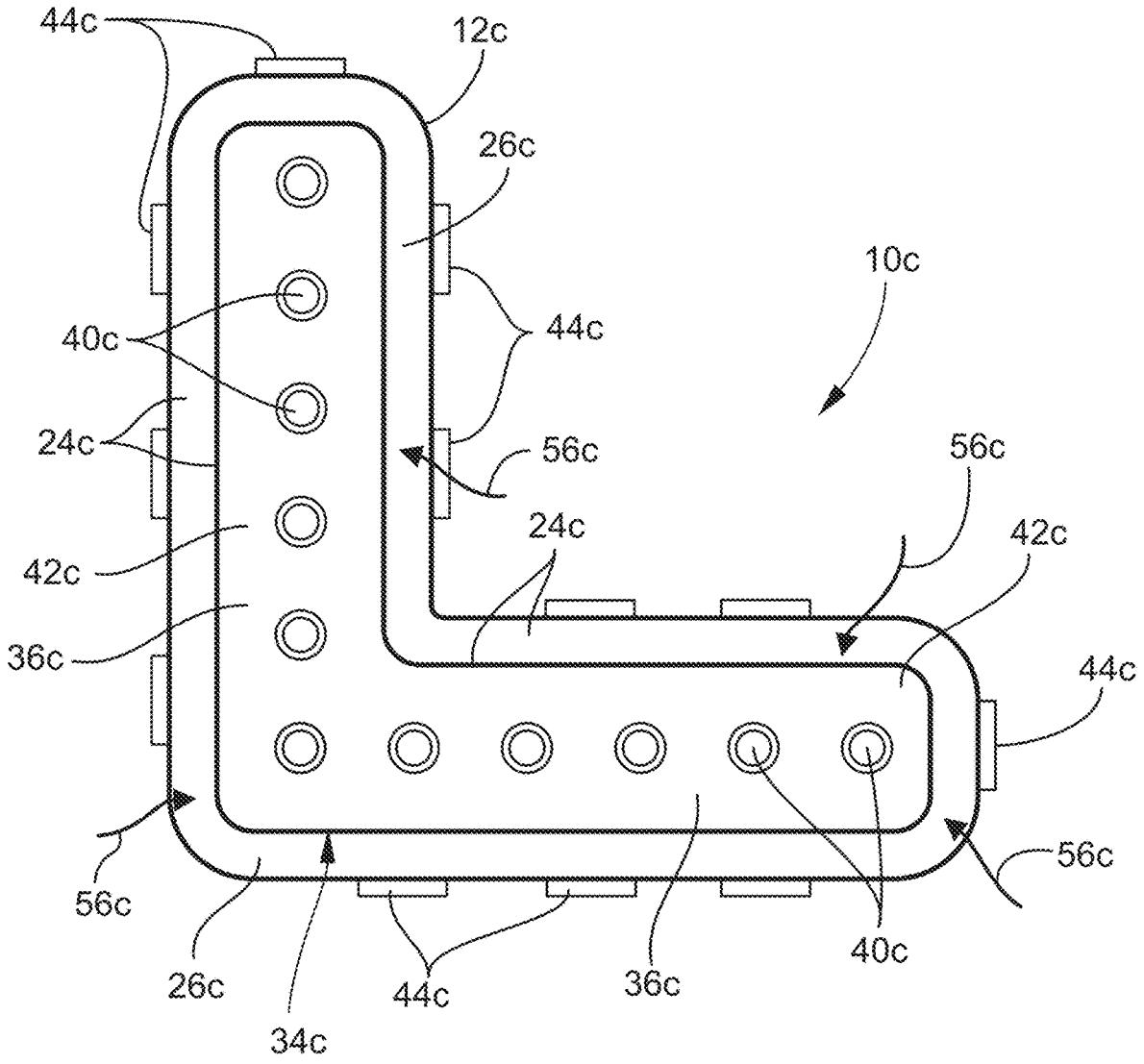
FIG. 4 is a bottom view of an air evacuator according to one embodiment of the invention.

Although the invention has been shown and described as utilizing conical shaped domes for evacuating and purifying air, it will be appreciated that various dome and evacuator shapes are also possible within the contemplated scope of the invention. Such variations can take the form of customized dome shapes, modular and multipositioned domes, and compound evacuator units. For example, FIG. 4 depicts a bottom view of an air evacuator 10*a* of the invention having an L-shaped dome 12*c*, inlet 34*c*, light trap 24*c*, lamp plate 36*c*, and arrangement of non-UV illuminating lamps 40*c*. Such configurations could incorporate modular or egg-carton shaped domes, multiple vents, fans, and filters, and would be appropriate for use over unusually-shaped activity areas such as L-shaped counters. Non-UV illuminating lamps 40*c* can be used that can be individually adjusted to direct non-UV illuminating light to specific project or task areas of a particular counter so that multiple tasks or projects can be simultaneously illuminated. Exterior-aimed ultraviolet lights 44*c* are positioned around the edges to provide customized a UV-light treatment configuration matching the unusually-shaped activity area below the air evacuator 10*c*. It will be appreciated that other specialized air evacuator shapes are also possible within the contemplated invention scope.

Figure 5:
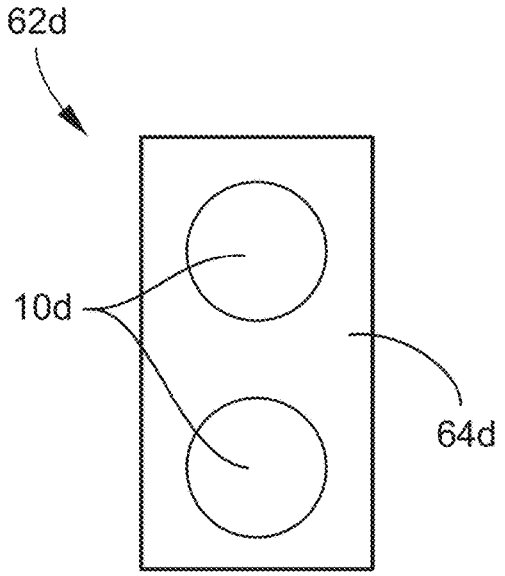
FIG. 5 depicts an arrangement of air evacuator domes contemplated by the invention.
Figure 6:
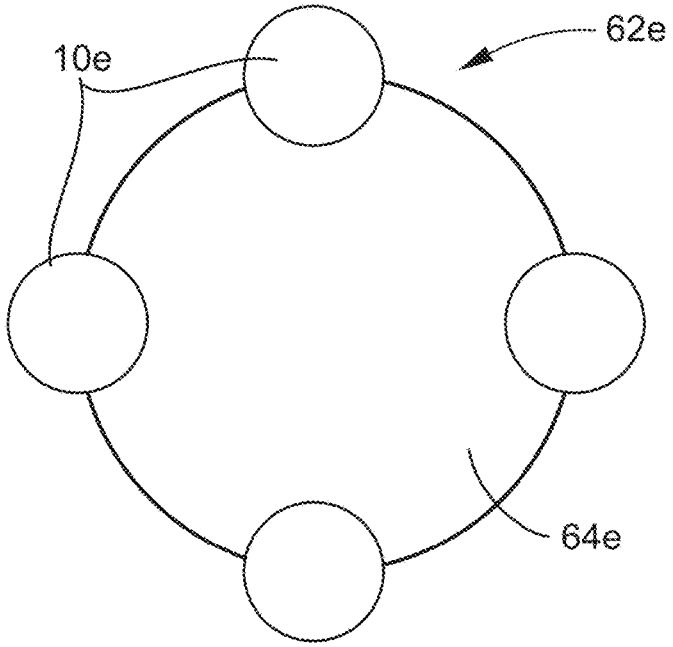
FIG. 6 depicts an arrangement of air evacuator domes contemplated by the invention.
Figure 7:
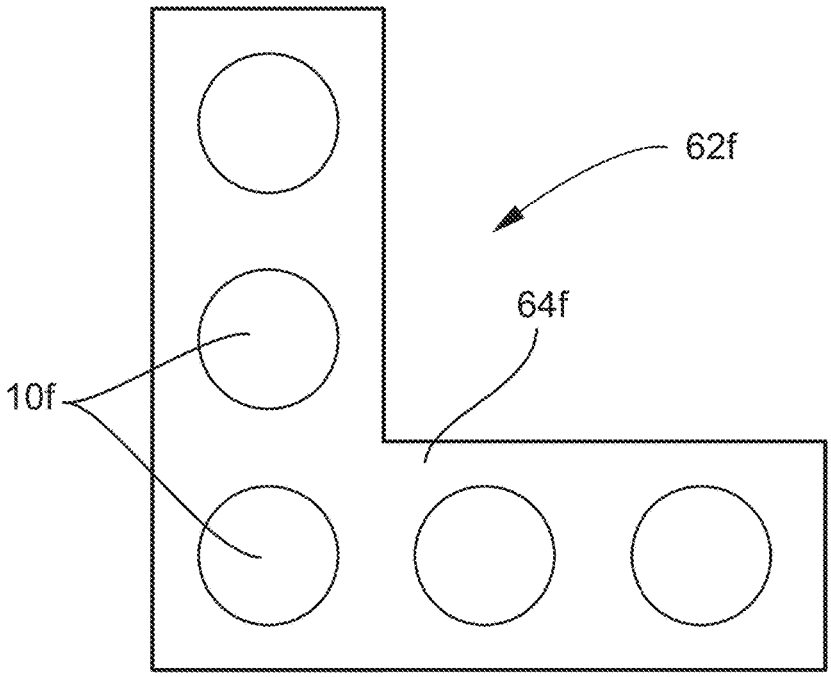
FIG. 7 depicts an arrangement of air evacuator domes contemplated by the invention.

It will be further appreciated that multiple domes can be used in a single or modular air evacuator to accommodate variations in activity areas or specific applications. For the purposes of illustration, activity areas will be discussed in FIGS. 5-7 as represented by tables or counters. For example FIG. 5 depicts a top view of a dome placement scheme 62*d* for an air evacuator utilizing two domes 10*d* to optimally evacuate and purify air over a rectangular table or counter 64*d*. FIG. 6 depicts a top view of a dome placement scheme 62*e* for an air evacuator utilizing four domes 10*e* to optimally evacuate and purify air over a circular table or counter 64*e*. FIG. 7 depicts a top view of a dome placement scheme 62*f* for an air evacuator utilizing five domes 10*f* to optimally evacuate and purify air over an L-shaped table or counter 64*f*. The table or counter 64*f*, domes 10*f*, and placement scheme 62*f* of FIG. 7 in particular demonstrate how multiple conical dome placement can be used in lieu of utilizing a customized dome or air evacuator shape, such as the analogous L-shaped air evacuator in FIG. 4.

Figure 8:
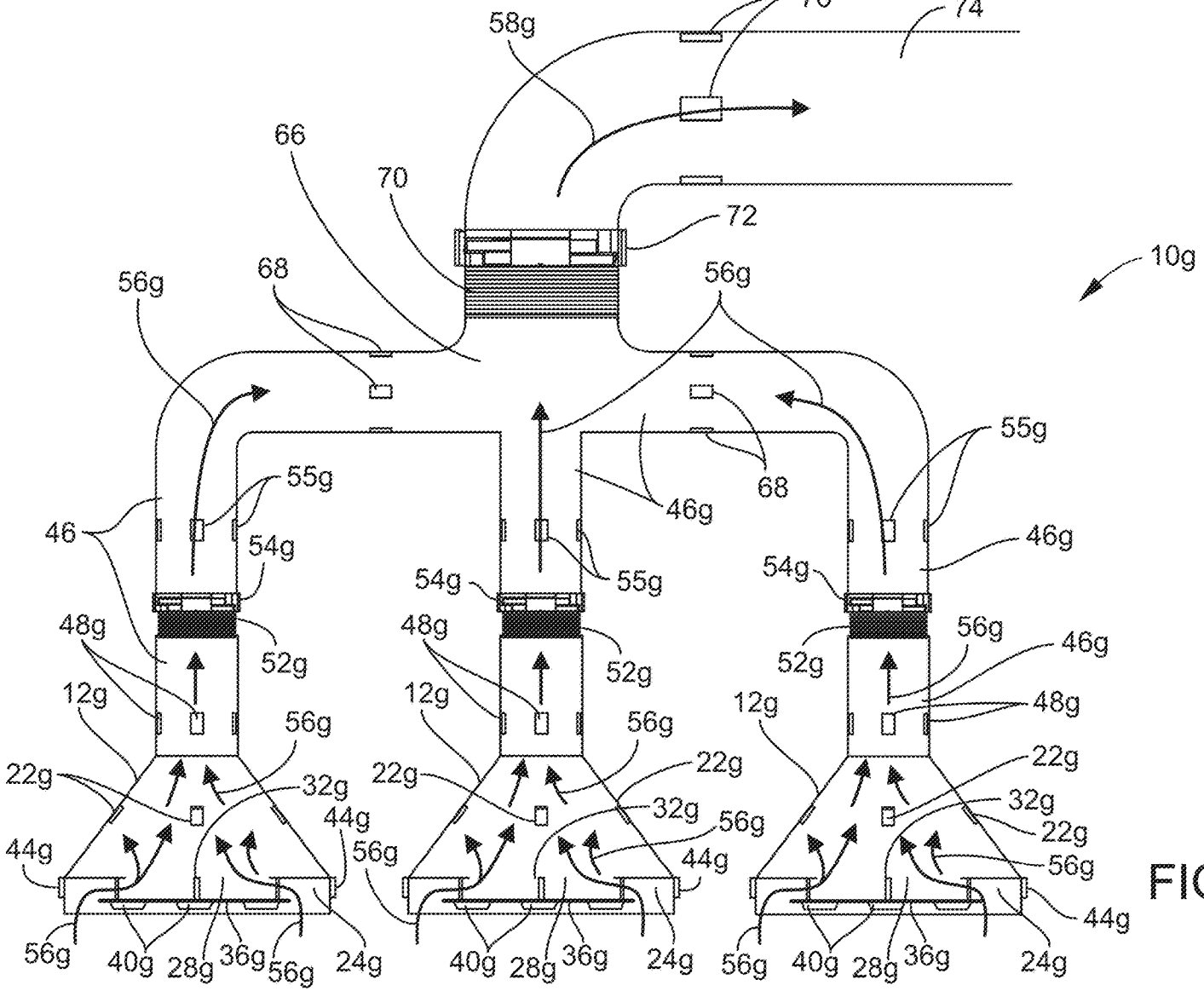
FIG. 8 is a side cross sectional view of an air evacuator according to one embodiment of the invention.

FIG. 8 depicts a cross sectional side view of an air evacuator 10*g* of the invention utilizing multiple domes 12*g* such as in the multiple dome placement schemes 62*d*, 62*e*, and 62*f* in FIGS. 5-7. As depicted in FIG. 8, each individual dome 12*g* has an associated lamp plate 36*g*, light trap 24*g*, exterior-aimed ultraviolet lights 44*g*, vent tube 46*g*, interior-aimed ultraviolet lights 22*g* and 55*g*, filter 52*g*, and fan 54*g*. In some embodiments, each individual non-UV illuminating lamp 40*g* may be in fixed position or be individually adjustable to allow for fine tuning the direction of illumination or for simultaneous illumination of multiple locations in the activity area. The vent tubes 46*g* channel evacuated air past a fourth stage of interior-aimed ultraviolet lights 68 for further UV light treatment and then to a common airflow convergence point 66 from which air is channeled through a larger convergence filter 70, convergence fan 72, and fifth stage of interior-aimed ultraviolet lights 76 before the purified airflow 56*g* is channeled away through a convergence duct 74 for disposal or recirculation.

Those skilled in the art will also realize that this invention is capable of other embodiments different from those shown and described. It will be appreciated that the detail of the structure of the disclosed apparatuses and methodologies can be changed in various ways without departing from the invention itself. Accordingly, the drawings and Detailed Description of the Invention are to be regarded as including such equivalents as do not depart from the spirit and scope of the invention.

The invention claimed is:

1. An air evacuator comprising:

a dome having an exterior surface, an interior funneling surface, an air intake end, and an air outlet end, said dome being wider at said air intake end than at said air outlet end;

an inlet to allow air from outside said air evacuator to be drawn into said dome;

a vent tube for receiving air from said air outlet end of said dome;

an air pump for moving air in said air evacuator;

a filter for filtering air drawn into said air evacuator;

at least one interior-aimed ultraviolet lamp positioned within said air evacuator to treat air drawn into said air evacuator;

a light trap extending substantially across said air intake end of said dome, said light trap preventing ultraviolet light from said at least one ultraviolet lamp from shining directly out from within said dome through said air intake end of said dome; and at least one exterior ultraviolet lamp positioned on said air evacuator to treat air and or surfaces exterior to said air evacuator.

2. The air evacuator of claim 1 wherein said at least one interior-aimed ultraviolet lamp is positioned on said interior funneling surface and within said dome.

3. The air evacuator of claim 1 wherein said dome is positioned above an activity area to draw in, treat, and circulate air present in said activity area.

4. The air evacuator of claim 1 further comprising at least one non-ultraviolet illuminating light for illuminating areas in a vicinity of said air evacuator when humans are in the vicinity of said air evacuator.

5. The air evacuator of claim 1 further comprising at least one non-ultraviolet illuminating light for illuminating areas in a vicinity of said air evacuator when humans are in the vicinity of said air evacuator, said illuminating light being adjustable to focus non-ultraviolet light to selected areas in the vicinity of said air evacuator.

6. The air evacuator of claim 1 further comprising at least one non-ultraviolet illuminating light for illuminating areas in a vicinity of said air evacuator when humans are in the vicinity of said air evacuator, said illuminating light being positioned over an activity area to treat and circulate air in the activity area.

7. The air evacuator of claim 1 wherein said light trap comprises an inner ring and an outer plate, said inner ring and outer plate positioned near said intake end of said dome.

8. The air evacuator of claim 1 wherein said interior funneling surface of said dome is lined with antimicrobial material.

9. The air evacuator of claim 1 wherein said interior funneling surface of said dome is lined with copper.

10. The air evacuator of claim 1 wherein said dome is constructed of antimicrobial material.

11. The air evacuator of claim 1 wherein said dome is constructed of copper.

12. The air evacuator of claim 1 wherein said vent tube is lined with antimicrobial material.

13. The air evacuator of claim 1 wherein said vent tube is constructed of antimicrobial material.

14. The air evacuator of claim 1 wherein said vent tube is lined with copper.

15. The air evacuator of claim 1 wherein said vent tube is constructed of copper.

16. The air evacuator of claim 1 wherein said interior funneling surface of said dome is lined with copper.

17. The air evacuator of claim 1 wherein said air pump is a fan.

18. The air evacuator of claim 1 wherein said air pump is an impeller.

19. The air evacuator of claim 1 wherein said air pump is a diaphragm pump.

20. The air evacuator of claim 1 wherein said air pump is a fan having antimicrobial blades.

21. The air evacuator of claim 1 further comprising multiple stages of ultraviolet lamps positioned at different locations within said air evacuator to allow for multiple stages of ultraviolet air treatment by said air evacuator.

22. The air evacuator of claim 1 wherein said outlet end of said dome is circular.

23. The air evacuator of claim 1 wherein said outlet end of said dome is L-shaped.

24. An air evacuator comprising:

a dome having an exterior surface, an interior funneling surface, an air intake end, and an air outlet end, said dome being wider at said air intake end than at said air outlet end;

an inlet to allow air from outside said air evacuator to be drawn into said dome;

a vent tube for receiving air from said air outlet end of said dome;

an air pump for moving air in said air evacuator;

a filter for filtering air drawn into said air evacuator;

at least one interior-aimed ultraviolet lamp positioned within said air evacuator to treat air drawn into said air evacuator;

a light trap extending substantially across said air intake end of said dome, said light trap preventing ultraviolet light from said at least one ultraviolet lamp from shining directly out from within said dome through said air intake end of said dome; and at least one exterior-aimed ultraviolet lamp positioned on said air evacuator to treat air or surfaces exterior to said air evacuator when humans are not in a vicinity of said air evacuator.

25. The air evacuator of claim 24 wherein said at least one interior-aimed ultraviolet lamp is positioned on said interior funneling surface and within said dome.

26. The air evacuator of claim 24 wherein said dome is positioned above an activity area to draw in, treat, and circulate air present in said activity area.

27. The air evacuator of claim 24 further comprising at least one non-ultraviolet illuminating light for illuminating areas in the vicinity of said air evacuator when humans are in the vicinity of said air evacuator.

28. The air evacuator of claim 24 further comprising at least one non-ultraviolet illuminating light for illuminating areas in the vicinity of said air evacuator when humans are in the vicinity of said air evacuator, said illuminating light being adjustable to focus non-ultraviolet light to selected areas in the vicinity of said air evacuator.

29. The air evacuator of claim 24 further comprising at least one non-ultraviolet illuminating light for illuminating areas in the vicinity of said air evacuator when humans are in the vicinity of said air evacuator, said illuminating light being positioned over an activity area to treat and circulate air in the activity area.

30. The air evacuator of claim 24 wherein said light trap comprises an inner ring and an outer plate, said inner ring and outer plate positioned near said intake end of said dome.

31. The air evacuator of claim 24 wherein said exterior-aimed ultraviolet lamp is included among a string of ultraviolet lamps.

32. The air evacuator of claim 24 wherein said exterior-aimed ultraviolet lamp further comprises an ultraviolet bulb.

33. The air evacuator of claim 24 wherein said interior funneling surface of said dome is lined with antimicrobial material.

34. The air evacuator of claim 24 wherein said interior funneling surface of said dome is lined with copper.

35. The air evacuator of claim 24 wherein said dome is constructed of antimicrobial material.

36. The air evacuator of claim 24 wherein said dome is constructed of copper.

37. The air evacuator of claim 24 wherein said vent tube is lined with antimicrobial material.

38. The air evacuator of claim 24 wherein said vent tube is constructed of antimicrobial material.

39. The air evacuator of claim 24 wherein said vent tube is lined with copper.

40. The air evacuator of claim 24 wherein said vent tube is constructed of copper.

41. The air evacuator of claim 24 wherein said interior funneling surface of said dome is lined with copper.

42. The air evacuator of claim 24 wherein said air pump is a fan.

43. The air evacuator of claim 24 wherein said air pump is an impeller.

44. The air evacuator of claim 24 wherein said air pump is a diaphragm pump.

45. The air evacuator of claim 24 wherein said air pump is a fan having antimicrobial blades.

46. The air evacuator of claim 24 further comprising multiple stages of ultraviolet lamps positioned at different locations within said air evacuator to allow for multiple stages of ultraviolet air treatment by said air evacuator.

47. The air evacuator of claim 24 wherein said outlet end of said dome is circular.

48. The air evacuator of claim 24 wherein said outlet end of said dome is L-shaped.

49. An air evacuator comprising:

a dome having an exterior surface, an interior funneling surface, an air intake end, and an air outlet end, said dome being significantly wider at said air intake end than at said air outlet end;

an inlet to allow air from outside said air evacuator to be drawn into said dome;

a vent tube for receiving air from said air outlet end of said dome;

an air pump for moving air in said air evacuator;

a filter for filtering air drawn into said air evacuator;

at least one interior-aimed ultraviolet lamp positioned within said air evacuator to treat air drawn into said air evacuator;

at least one non-ultraviolet illuminating light for illuminating areas in a vicinity of said air evacuator when humans are in the vicinity of said air evacuator;

a light trap extending substantially across said air intake end of said dome, said light trap preventing ultraviolet light from said at least one ultraviolet lamp from shining directly out from within said dome through said air intake end of said dome; and at least one exterior-aimed ultraviolet lamp positioned on said air evacuator to treat air or surfaces exterior to said air evacuator when humans are not in the vicinity of said air evacuator.

50. The air evacuator of claim 49 wherein said at least one interior-aimed ultraviolet lamp is positioned on said interior funneling surface and within said dome.

51. The air evacuator of claim 49 wherein said dome is positioned above an activity area to draw in, treat, and circulate air present in said activity area.

52. The air evacuator of claim 49 wherein said illuminating light is adjustable to focus non-ultraviolet light to selected areas in the vicinity of said air evacuator.

53. The air evacuator of claim 49 wherein said illuminating light is positioned over an activity area to treat and circulate air in the activity area.

54. The air evacuator of claim 49 wherein said light trap comprises an inner ring and an outer plate, said inner ring and outer plate positioned near said intake end of said dome.

55. The air evacuator of claim 49 wherein said exterior-aimed ultraviolet lamp is included among a string of ultraviolet lamps.

56. The air evacuator of claim 49 wherein said exterior-aimed ultraviolet lamp further comprises an ultraviolet bulb.

57. The air evacuator of claim 49 wherein said interior funneling surface of said dome is lined with antimicrobial material.

58. The air evacuator of claim 49 wherein said interior funneling surface of said dome is lined with copper.

59. The air evacuator of claim 49 wherein said dome is constructed of antimicrobial material.

60. The air evacuator of claim 49 wherein said dome is constructed of copper.

61. The air evacuator of claim 49 wherein said vent tube is lined with antimicrobial material.

62. The air evacuator of claim 49 wherein said vent tube is constructed of antimicrobial material.

63. The air evacuator of claim 49 wherein said vent tube is lined with copper.

64. The air evacuator of claim 49 wherein said vent tube is constructed of copper.

65. The air evacuator of claim 49 wherein said interior funneling surface of said dome is lined with copper.

66. The air evacuator of claim 49 wherein said air pump is a fan.

67. The air evacuator of claim 49 wherein said air pump is an impeller.

68. The air evacuator of claim 49 wherein said air pump is a diaphragm pump.

69. The air evacuator of claim 49 wherein said air pump is a fan having antimicrobial blades.

70. The air evacuator of claim 49 further comprising multiple stages of ultraviolet lamps positioned at different locations within said air evacuator to allow for multiple stages of ultraviolet air treatment by said air evacuator.

71. The air evacuator of claim 49 wherein said outlet end of said dome is circular.

72. The air evacuator of claim 49 wherein said outlet end of said dome is L-shaped.

73. An air evacuator comprising:

a dome having an exterior surface, an interior funneling surface, an air intake end, and an air outlet end, said dome being wider at said air intake end than at said air outlet end;

an inlet to allow air from outside said air evacuator to be drawn into said dome;

a vent tube for receiving air from said air outlet end of said dome;

an air pump for moving air in said air evacuator;

a filter for filtering air drawn into said air evacuator;

at least one first stage interior-aimed ultraviolet lamp positioned on said interior funneling surface and within said dome;

at least one second stage interior-aimed ultraviolet lamp positioned within said air evacuator between said first stage interior-aimed ultraviolet lamp and said air pump;

at least one third stage interior-aimed ultraviolet lamp positioned within said air evacuator in said vent tube;

a light trap extending substantially across said air intake end of said dome, said light trap preventing ultraviolet light from said at least one ultraviolet lamp from shining directly out from within said dome through said air intake end of said dome; and at least one exterior-aimed ultraviolet lamp positioned on said air evacuator to treat air or surfaces exterior to said air evacuator when humans are not in a vicinity of said air evacuator.

74. The air evacuator of claim 73 wherein said dome is positioned above an activity area to draw in, treat, and circulate air present in said activity area.

75. The air evacuator of claim 73 further comprising at least one non-ultraviolet illuminating light for illuminating areas in the vicinity of said air evacuator when humans are in the vicinity of said air evacuator.

76. The air evacuator of claim 73 further comprising at least one non-ultraviolet illuminating light for illuminating areas in the vicinity of said air evacuator when humans are in the vicinity of said air evacuator, said illuminating light being adjustable to focus non-ultraviolet light to selected areas in the vicinity of said air evacuator.

77. The air evacuator of claim 73 further comprising at least one non-ultraviolet illuminating light for illuminating areas in the vicinity of said air evacuator when humans are in the vicinity of said air evacuator, said illuminating light being positioned over an activity area to treat and circulate air in the activity area.

78. The air evacuator of claim 73 wherein said light trap comprises an inner ring and an outer plate, said inner ring and outer plate positioned near said intake end of said dome.

79. The air evacuator of claim 73 wherein said exterior-aimed ultraviolet lamp is included among a string of ultraviolet lamps.

80. The air evacuator of claim 73 wherein said exterior-aimed ultraviolet lamp further comprises an ultraviolet bulb.

81. The air evacuator of claim 73 wherein said interior funneling surface of said dome is lined with antimicrobial material.

82. The air evacuator of claim 73 wherein said interior funneling surface of said dome is lined with copper.

83. The air evacuator of claim 73 wherein said dome is constructed of antimicrobial material.

84. The air evacuator of claim 73 wherein said dome is constructed of copper.

85. The air evacuator of claim 73 wherein said vent tube is lined with antimicrobial material.

86. The air evacuator of claim 73 wherein said vent tube is constructed of antimicrobial material.

87. The air evacuator of claim 73 wherein said vent tube is lined with copper.

88. The air evacuator of claim 73 wherein said vent tube is constructed of copper.

89. The air evacuator of claim 73 wherein said interior funneling surface of said dome is lined with copper.

90. The air evacuator of claim 73 wherein said air pump is a fan.

91. The air evacuator of claim 73 wherein said air pump is an impeller.

92. The air evacuator of claim 73 wherein said air pump is a diaphragm pump.

93. The air evacuator of claim 73 wherein said air pump is a fan having antimicrobial blades.

94. The air evacuator of claim 73 further comprising multiple stages of ultraviolet lamps positioned at different locations within said air evacuator to allow for multiple stages of ultraviolet air treatment by said air evacuator.

95. The air evacuator of claim 73 wherein said outlet end of said dome is circular.

96. The air evacuator of claim 73 wherein said outlet end of said dome is L-shaped.

97. An air evacuator comprising:

a plurality of domes, said domes having exterior surfaces, interior funneling surfaces, air intake ends, and air outlet ends, said domes being significantly wider at said air intake ends than at said air outlet ends;

said domes having inlets to allow air from outside said air evacuators to be drawn into said domes;

a plurality of vent tubes for receiving air from said air outlet ends of said domes;

a plurality of vent tube air pumps for moving air in said air evacuator, each said vent tube air pump located in a said vent tube;

a plurality of vent tube filters for filtering air drawn into said air evacuator, each said vent tube filter located in a said vent tube;

each of said vent tubes positioned to channel air into a single shared exhaust tube, said exhaust tube positioned to channel air out of said air evacuator;

an evacuation filter for filtering air channeled into said shared exhaust tube;

an evacuation air pump for moving air channeled into said shared exhaust tube;

a plurality of first stage interior-aimed ultraviolet lamps positioned on said interior funneling surfaces and within said domes;

a plurality of second stage interior-aimed ultraviolet lamps positioned within said air evacuator between said first stage interior-aimed ultraviolet lamps and said air pumps;

a plurality of third stage interior-aimed ultraviolet lamps positioned within said vent tubes between said vent tube air pumps and said evacuation air pump;

light traps extending substantially across said air intake ends of said domes, said light traps preventing ultraviolet light from said first stage ultraviolet lamps from shining directly out from within said domes through said air intake ends of said domes; and a plurality of exterior-aimed ultraviolet lamps positioned on said domes to treat air or surfaces exterior to said air evacuator when humans are not in a vicinity of said air evacuator.

98. The air evacuator of claim 97 further comprising at least one fourth stage interior-aimed ultraviolet lamp positioned within said shared exhaust tube.

99. The air evacuator of claim 97 wherein said domes are positioned above activity areas to draw in, treat, and circulate air present in said activity areas.

100. The air evacuator of claim 97 further comprising non-ultraviolet illuminating lights for illuminating areas in the vicinities of said domes when humans are in the vicinities of said air evacuator.

101. The air evacuator of claim 97 further comprising non-ultraviolet illuminating lights for illuminating areas in the vicinities of said domes when humans are in the vicinities of said domes, said illuminating lights being adjustable to focus non-ultraviolet light to selected areas in the vicinities of said domes.

102. The air evacuator of claim 97 further comprising at least one non-ultraviolet illuminating light for illuminating areas in the vicinity of said air evacuator when humans are in the vicinity of said air evacuator, said illuminating light being positioned over an activity area to treat and circulate air in the activity area.

103. The air evacuator of claim 97 wherein said light traps comprise inner rings and an outer plates, said inner rings and outer plates positioned near said intake ends of said domes.

104. The air evacuator of claim 97 wherein said exterior-aimed ultraviolet lamps are included among strings of ultraviolet lamps.

105. The air evacuator of claim 97 wherein said exterior-aimed ultraviolet lamps further comprise ultraviolet bulbs.

106. The air evacuator of claim 97 wherein said interior funneling surfaces of said domes are lined with antimicrobial material.

107. The air evacuator of claim 97 wherein said interior funneling surfaces of said domes are lined with copper.

108. The air evacuator of claim 97 wherein said domes are constructed of antimicrobial material.

109. The air evacuator of claim 97 wherein said domes are constructed of copper.

110. The air evacuator of claim 97 wherein said vent tubes are lined with antimicrobial material.

111. The air evacuator of claim 97 wherein said vent tubes are constructed of antimicrobial material.

112. The air evacuator of claim 97 wherein said vent tubes are lined with copper.

113. The air evacuator of claim 97 wherein said vent tubes are constructed of copper.

114. The air evacuator of claim 97 wherein said interior funneling surfaces of said domes are lined with copper.

115. The air evacuator of claim 97 wherein said air pumps are fans.

116. The air evacuator of claim 97 wherein said air pumps are impellers.

117. The air evacuator of claim 97 wherein said air pumps are diaphragm pumps.

118. The air evacuator of claim 97 wherein said air pumps are fans having antimicrobial blades.

119. The air evacuator of claim 97 further comprising multiple stages of ultraviolet lamps positioned at different locations within said air evacuator to allow for multiple stages of ultraviolet air treatment by said air evacuator.

120. The air evacuator of claim 97 wherein said outlet ends of said domes are circular.

121. The air evacuator of claim 97 wherein said outlet ends of said domes are L-shaped.

* * * * *